US009849462B2

(12) United States Patent
Snoby et al.

(10) Patent No.: US 9,849,462 B2
(45) Date of Patent: Dec. 26, 2017

(54) SIFTING APPARATUSES

(71) Applicants: Richard Snoby, Roswell, GA (US); Andrew C. Snoby, Cumming, GA (US)

(72) Inventors: Richard Snoby, Roswell, GA (US); Andrew C. Snoby, Cumming, GA (US)

(73) Assignee: SNOBY SEPARATION SYSTEMS, LLC, Dahlonega, GA (US)

( * ) Notice: Subject to any disclaimer, the term of this patent is extended or adjusted under 35 U.S.C. 154(b) by 0 days.

(21) Appl. No.: 15/145,240

(22) Filed: May 3, 2016

(65) Prior Publication Data

US 2017/0072404 A1 Mar. 16, 2017

Related U.S. Application Data

(63) Continuation-in-part of application No. 14/855,418, filed on Sep. 16, 2015, now Pat. No. 9,561,510.

(51) Int. Cl.

| | |
|---|---|
| ***B03B 4/00*** | (2006.01) |
| ***B03B 4/06*** | (2006.01) |
| ***B07B 4/08*** | (2006.01) |
| ***B07B 11/04*** | (2006.01) |
| ***B07B 11/06*** | (2006.01) |
| ***B07B 11/02*** | (2006.01) |

(52) U.S. Cl.

CPC ..... *B03B 4/005* (2013.01); *B03B 4/065* (2013.01); *B07B 4/08* (2013.01); *B07B 11/02* (2013.01); *B07B 11/04* (2013.01); *B07B 11/06* (2013.01)

(58) Field of Classification Search

CPC ..... B07B 4/08; B07B 11/02; B07B 11/04; B07B 11/06; B03B 4/005; B03B 4/065

USPC ..... 209/475

See application file for complete search history.

(56) References Cited

U.S. PATENT DOCUMENTS

| | | | | |
|---|---|---|---|---|
| 2,731,147 | A * | 1/1956 | Krebs | B04C 5/13 209/725 |
| 3,852,168 | A | 12/1974 | Oetiker | |
| 6,467,631 | B2 * | 10/2002 | Strangalies | B03B 4/005 209/474 |
| 6,688,494 | B2 * | 2/2004 | Pozarnsky | B01D 47/00 222/4 |
| 6,948,888 | B2 * | 9/2005 | Reichler | B05B 7/1404 222/195 |
| 7,171,963 | B2 | 2/2007 | Jagger et al. | |

(Continued)

OTHER PUBLICATIONS

"Non-Final Office Action dated Aug. 18, 2016", U.S. Appl. No. 14/855,418, 9 pages.

*Primary Examiner* — Terrell Matthews
(74) *Attorney, Agent, or Firm* — Baker Donelson Nigamnarayan Acharya

(57) ABSTRACT

Sifting apparatuses for stratifying raw material including a material feed-in device, a material support unit, a gas plenum, a discharge control mechanism, and a reservoir are described. The material support unit receives material from the material feed-in device and has a surface with a plurality of openings for a gaseous medium introduced from underneath the material support unit, thereby effecting loosening and stratification of the material into a layer of relatively heavier material, and a layer of relatively lighter material atop the relatively heavier material. The introduced gaseous medium originates in a pump, is collected in a pressurized reservoir, and is controlled by a metered valve prior to introduction to the material support unit.

18 Claims, 6 Drawing Sheets

(56) References Cited

U.S. PATENT DOCUMENTS

| | | | | |
|---|---|---|---|---|
| 9,033,155 | B2 * | 5/2015 | Sorhuus | B03B 4/06 209/250 |
| 9,327,320 | B1 * | 5/2016 | Coolidge | B07B 4/08 |
| 2010/0184861 | A1 | 7/2010 | Politi et al. | |
| 2013/0341251 | A1 * | 12/2013 | Blendinger | B03D 1/028 209/164 |

* cited by examiner

SIFTING APPARATUSES

CROSS-REFERENCE TO RELATED APPLICATION DATA

This application is a Continuation-In-Part application based on U.S. patent application Ser. No. 14/855,418, filed Sep. 16, 2015, which claims priority to U.S. Provisional Patent Application No. 62/051,184, filed Sep. 16, 2014, both of which are incorporated herein by reference in their entireties.

FIELD

This disclosure relates generally to sifting apparatuses and, more specifically, to sifting apparatuses for preparatory concentration of raw materials including, e.g., raw coal.

BACKGROUND

Sifting or settling apparatuses generally include a material feed device, material support unit with holes through which flows a gaseous fluid, often gas guided by a plenum disposed underneath the material support unit, and a discharge control mechanism for controlling separated discharge of relatively heavier material and relatively lighter material. The inflowing pulsed gas operating to loosen the material fed onto the material support unit stratifies the material into layers of relatively lighter material atop of layers of relatively heavier material. An air sifting apparatus of this type is described, for example, in the publication Schubert "Aufbereitung fester mineralischer Rohstoffe", Band II VEB Deutscher Verlag fuer Grundstoffindustrie, Leipzig, pages 89 and 90.

Typically, sifting apparatuses, like the one described above, produce a less distinct separation between the heavier and lighter materials when compared with wet sifting machines. To achieve satisfactory sorting results according to the aforementioned apparatuses, traditionally multiple factors must be present including, for example, a large density difference between the components of the material. The material particles must be classified within a relatively narrow size range (i.e., within a narrowly defined kernel or grain size range), and the surfaces of the particles should be low in surface moisture, otherwise capillary retention forces hinder their relative movement.

SUMMARY

Sifting apparatuses ("jigs"), whether wet or dry, operate according to two functions: they stratify and then separate. Improved stratification can be achieved when the volume, acceleration, and pulse frequency of the gas or air used in the jigging stroke are each achieved with relative independence. The inclusion of a pressurized reservoir has not been utilized in dry jigging, and thus rapid decompression of the gaseous medium occurs in the gas plenum during each jigging stroke. This disclosure provides sifting apparatuses that offer a solution to the challenge of providing a jig in which the acceleration of the jigging stroke can be improved without excessive pressure loss in the plenum or at the pump discharge point and without deleterious flow change across the material support unit, whereby a better stratification can be achieved and thus the separation will be enhanced, while shock to the gaseous pumping device is reduced.

The solution to this challenge is principally comprised of providing a reservoir of sufficient size to accept gaseous flow from a pump to build a pressure and relatively large volume that will permit discharge of pulses of relatively smaller volumes as a controlled valve opens and closes, thereby causing flow of gas into the plenum, whereupon the pulsating gas flow is adjusted to a pulse strength sufficient to lift the particles of the material upward and, via the consequent varying distance of fall, thereby effect stratification of the material into relatively heavier material layers and relatively lighter material layers.

One embodiment includes a sifting apparatus having a material support unit having a base with one or more apertures located therethrough; a plenum attached to an underside of the material support unit; a gas or air dispenser, such as a metering valve, that is attached to the plenum, which is in communication with the material support unit, and that provides a pulsating gaseous medium flow to the material support unit; a pump in communication with the dispenser, wherein the pump provides a pressurized medium; a reservoir that maintains a threshold pressure and that is positioned between the pump and the dispenser; and a discharge control mechanism in communication with the material support unit and operable to control discharge of a relatively heavier material.

In accordance with embodiments of the jig, the pressure of the pulsating gas flow can also be adjusted by the proper selection of a pump, which will pressurize the reservoir.

In a further aspect of the present disclosure, the reservoir of the sifting apparatus is placed vertically below the plenum. By doing so, an improved stratification of materials, as compared to traditional jigs, is achieved. Moreover, by placing the reservoir vertically below the plenum, turbulence and unexpected direction of pulsated air flows are reduced, thereby allowing the pulsated air to more evenly disperse under and through the material support unit. This creates a better and more consistent stratification of material, and subsequently an improvement in separation of materials as compared to traditional jigs.

Yet a further aspect of the present disclosure relates to an interface detection detector capable of mimicking a particle at an interface between relatively high and relatively low density layers of materials caused by air jigging. The particle mimicking interface detection detector is physically configured to stably "float" in materials of the density it is mimicking. Moreover, the interface detection detector may have an adjustable weight so that a user can adjust the weight of the interface detection detector to allow the interface detection detector to mimic particles of a different density. By implementing the interface detection detector of the present disclosure, the depth of a selected density layer of particles is identified relative to the location of the material support device. Further, through standard automatic control systems, the depth of a selected density layer may be constantly maintained, and a user does not need to visually and continuously monitor and adjust an outflow of materials from the material support unit. Implementation of the interface detection detector also allows for a determination of an optimal separation density divergence prior in time and distance to a discharge control mechanism of the air jig, thereby producing a purer separated product. Furthermore, implementation of the interface detection detector of the present disclosure eliminates the need for using nuclear devices currently used with air jigs.

Additional features and advantages of the present disclosure are described below. This disclosure may be readily utilized as a basis for modifying or designing other structures, systems, and processes for carrying out the same purposes of the present disclosure. It should also be realized by those skilled in the art that such equivalent implementations do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

The particular features and advantages of the present disclosure will be apparent from the detailed description set forth below in conjunction with the drawings in which like reference characters identify corresponding aspects throughout.

DETAILED DESCRIPTION

Figure 1:
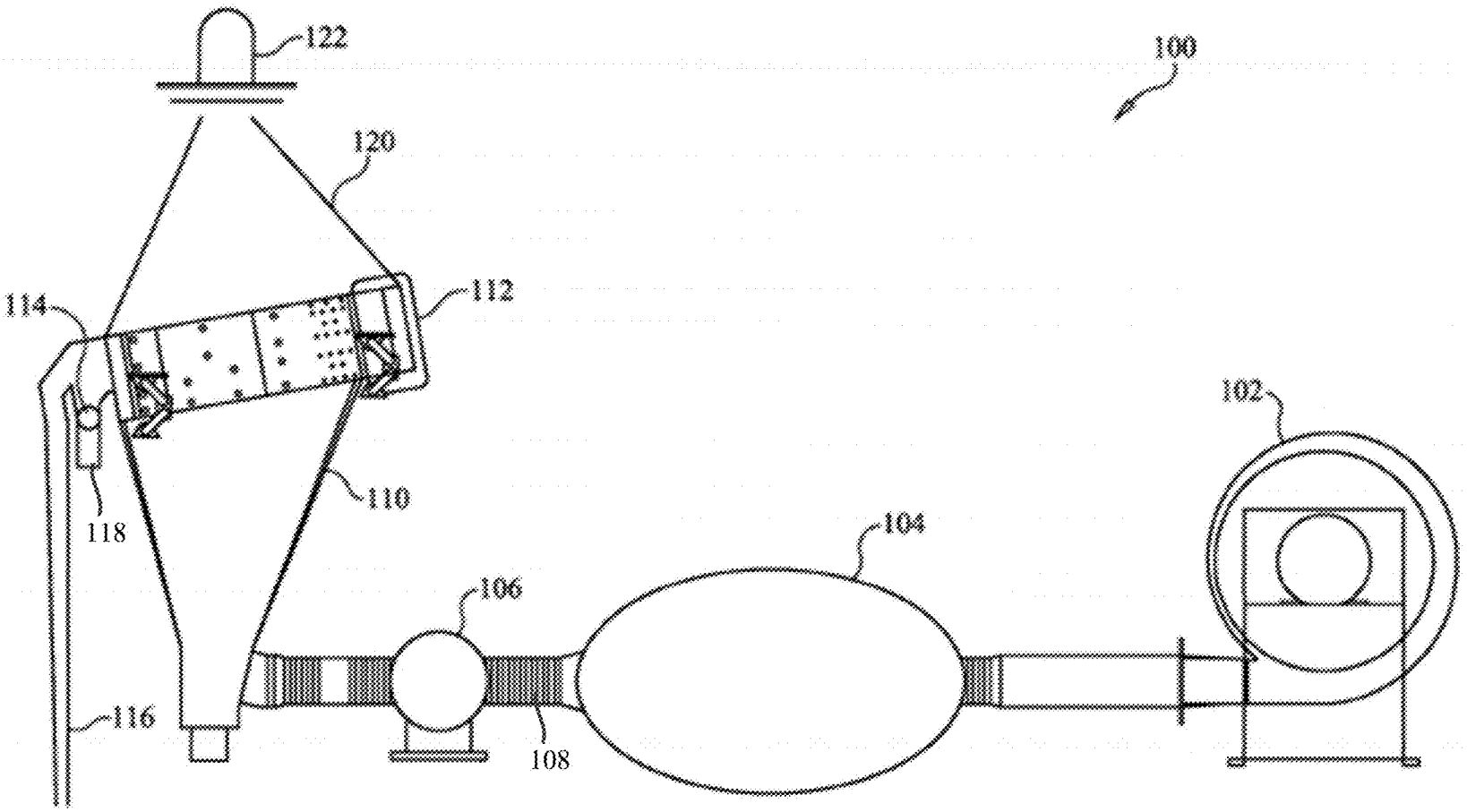
FIG. 1 is a schematic side view of embodiments of a sifting apparatus of the present disclosure having a reservoir.

As shown in FIG. 1, a sifting apparatus or jig 100 may include a pressure build up system including a pump 102 and reservoir 104, a pressure release unit including a metering valve 106 and adjustable orifice 108, a plenum 110, a material support unit 112, a discharge control mechanism 114, a light product discharge channel 116, a heavy product discharge channel 118, a dust collection housing 120, and a ducting 122 coupled to the dust collection housing 120. As can be seen from FIG. 1, the arrangement of the pump 102, the plenum 110, and the reservoir 104 may be connected to or incorporated into other traditional gravity separators (e.g., having features such as, a material support unit 112, a light product discharge channel 116, a heavy product discharge channel 118, and a dust collection housing 120).

The pump 102, which assists in producing a gas or air flow to the remainder of the jig 100, may deliver gas or air at a relatively constant pressure to the reservoir 104, for example. This embodiment may extend the life of the jig 100 due to the structure of the jig 100 reducing the vacillation of pressure from intermittent flow of gas through the adjustable orifice 108. However, other embodiments may include variable or intermittent pressure being produced in the reservoir 104 by the pump 102.

The reservoir 104 stores air or gas supplied by the pump 102 and may have a pressure relief valve located thereon (not illustrated) for releasing excess pressure at or above a desired threshold. Such desired pressure threshold of the pressure release valve may be set by a user or may be determined according to the reservoir's 104 properties and capacity, for example. As illustrated, the reservoir 104 may be ovular in shape. However, the reservoir 104 may have any shape, size, and volume without deviating from the scope of the present disclosure. In further embodiments, the reservoir 104 may have a volume sufficient to reduce significant pressure drops in the reservoir 104 when a relatively smaller volume of air or gas is released to the rest of the jig 100.

The metering valve 106 allows for the flow of air or gas to the plenum 110 from the reservoir 104 and pump 102 to be controlled and adjusted. Also, a seal on the light material discharge or a gaslock similar to a star gate can be utilized to assist this. The metering valve 106 may be any device capable of adjusting and regulating gas flow (frequency of discharge and volume of gas) and may be controlled by various means such as electronically, wirelessly, Bluetooth, or direct user contact, for example. Proximate to the metering valve 106 may be an adjustable orifice 108 capable of regulating flow pressure or rate of the gas being released to the plenum 110, thereby allowing for the control of the frequency and volume of pulsations into the gas plenum 110. The adjustable orifice 108 may have outputs such as analog, digital, and audible, for example. Further, such outputs may be directly communicated to a user or may be indirectly communicated to a user through a computer. By providing relatively independent control of volume, pressure (i.e., acceleration of flow), and frequency of pulse using the adjustable orifice 108 and the metering valve 106, stratification and control of stratification of material on the material support unit 112 is enhanced. By producing enhanced stratification, the separation of relatively heavy material (e.g., iron) from relatively light material (e.g., coal) is also enhanced, thereby producing a more efficient jig 100.

The plenum 110 is in fluidic communication with the reservoir 104. As illustrated, the plenum 110 may have a conical shape, with a greater surface area located at the top of the plenum 110 and a smaller surface area located at the bottom of the plenum 110. However, the plenum 110 may have any shape or size without deviating from the scope of the present disclosure.

Also attached to the plenum 110 is the material support unit 112 that provides support for the heavy and light material mixture waiting to be stratified. A surface area upon which the material mixture is supported may include a plate or screen having holes there through. The material support unit 112 may be made of any material capable of supporting the material mixture, such as wood, metal, metal alloy, plastic, or any other material, for example. The material support unit 112 may also have any shape sufficient to encompass the material mixture. In one embodiment, the material support unit 112 may have a shape substantially similar, or identical, to that of the corresponding area of the plenum 110 upon which it couples. In other embodiments, the material support unit 112 may have a shape independent of the shape of the plenum 110.

The material support unit 112 also enhances the stratification of the material mixture by using movements such as rotation and pulsation, for example. The movement of the material support unit 112 may be provided by various means, including electronic, wireless, Bluetooth, or direct user contact, for example. The stratification of the material mixture is aided by a gaseous medium flow provided by the reservoir 104 and pump 102. In an embodiment, a pulsating gaseous medium flow provided to the mixture material periodically lifts the material to promote stratification of the mixture into a "heavy" material layer and a "light" material layer located atop the heavy material layer without significantly segregating the materials toward the ends or sides of the material support unit 112. In a further embodiment, the plenum 110 may produce a more constant gas flow through the openings of the material support unit 112 along with a pulsating air gas flow, overlaid on the constant air flow, the pulse impacting the material mixture on the material support unit 112. As illustrated, the material support unit 112 may be located at an angle within the jig 100. In other embodiments, the material support unit 112 may be oriented at different angles and orientations from that depicted in FIG. 1, including being directly or substantially horizontal, for example.

As illustrated, the light product discharge channel 116 is attached to the material support unit 112, proximate the discharge control mechanism 114. However, it should be appreciated that the light product discharge channel 116 may be attached to the plenum 110 at an area downstream from the material support unit 112, or another location of the jig 100 where heavy materials cannot access after separation. Located proximate to the material support unit 112 and the light product discharge channel 116 is the discharge control mechanism 114. The discharge control mechanism 114 allows for the adjustable selection or control of heavy material capable of passing through the discharge control mechanism 114 and the light product discharge channel 116. The discharge control mechanism 114 may be controlled by any sufficient means, such as electronically, wirelessly, Bluetooth, or by direct user contact, for example. Further, the discharge control mechanism 114 may include devices capable of determining densities of material, such as a nuclear sensor, X-ray sensor, optical sensor, or any other sensor capable of determining densities, for example. The discharge control mechanism 114 may also include a device capable of determining thicknesses of material, such as, for example, a mechanical sensor. The discharge control mechanism 114 may also be configured to direct the heavy material to a location separate from the light product discharge channel 116, such as the heavy product discharge channel 118. In an embodiment, the discharge control mechanism 114 may include a device capable of automatically controlling discharge of the heavy material.

As illustrated, the heavy product discharge channel 118 is located below the discharge control mechanism 114, proximate to the material support unit 112. However, it should be appreciated that the heavy product discharge channel 118 may be located elsewhere on the jig 100. For example, the heavy product discharge channel 118 may be attached to the plenum 110 (e.g., at a bottom of the plenum 110), directly on the material support unit 112, etc.

A dust collection housing 120, which manages the amount of dust released by the jig 100, may be attached to the material support unit 112 by fasteners such as screws, clamps, snaps, epoxies, resins, and seals, for example. Specific embodiments of the system may or may not have a dust collection housing 120. The dust collection housing 120 may be conical in shape, as illustrated in FIG. 1, or may be any other shape sufficient to trap dust.

A material feed-in device (not illustrated) may be proximate to the material support unit 112, and also may be proximate to the dust collection housing 120. In a further embodiment, the material feed-in device may be removably attached to the dust collection housing 120. The material feed-in device provides for replenishment of the material mixture to the material support unit 112. In so doing, the material feed-in device may provide the material mixture in uniform or substantially uniform dosages, or may also provide the material variably. Such manner of replenishment may be calculated according to volume, density, or weight of the material mixture, for example. In yet another embodiment, the material feed-in device may include a volume adjustment device.

Figure 2:
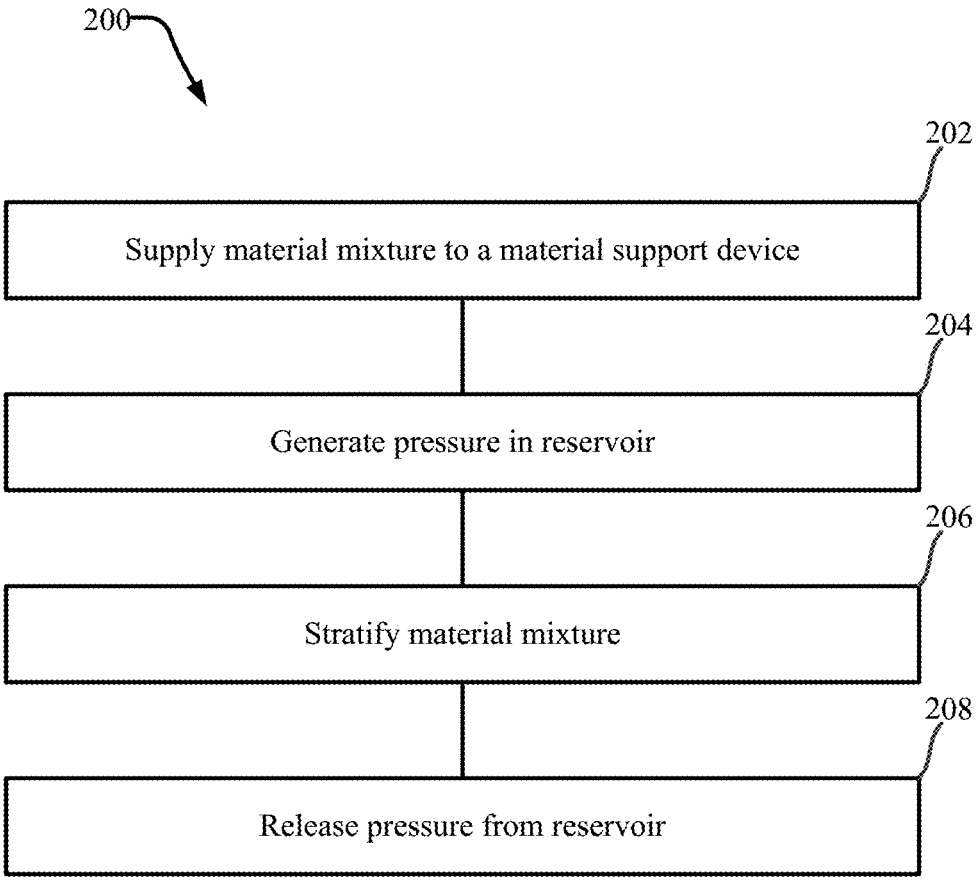
FIG. 2 is a flow diagram of embodiments of using the sifting apparatuses of the present disclosure.

As seen in FIG. 2, a method 200 of using a jig according to the present disclosure is depicted. At block 202 the material support unit is supplied with a material mixture containing at least one relatively heavier material and at least one relatively lighter material. This supplying of the material mixture may occur directly or may occur through the use of a material feed-in. Supplying of the material mixture may occur at a uniform rate or may occur in variable dosages based on, for example, volume, density, and/or mass of the material mixture.

At block 204 pressure is generated in the reservoir by using the pump. The pressure generated in the pump may be set by a user of the jig, or may be determined based on the physical characteristics of the reservoir and pumping power of the pump. At block 206 the material mixture located on the material support unit may be stratified. Such stratification may occur through the use of movements such as rotation, pulsation, and/or vibration of the material support unit, for example. At block 208 gas may be released from the reservoir to the material support unit. Such release of gas may be constant, or variable, or intermittent.

In one embodiment, the release of gas from the reservoir may include releasing the entirety of the pressure, built up in the reservoir, all at once. In other embodiments of the present disclosure, the gas stored in the reservoir may be released gradually so that there always remains some pressure buildup within the reservoir. In yet another embodiment, the release of pressure from the reservoir may include releasing a constant gas flow along with a pulsating gas flow overlaid on the constant gas flow, for pulses to impact the material mixture on the material support unit.

In operation and use, the sifting apparatus or arrangement may operate similar to other sifting apparatuses (e.g., a gravity separator) or with other sifting apparatuses. Material to be handled is fed onto a support device e.g., through a funnel, which can perform the dosing preparation of the material. Gas or air introduced constantly flows upwardly through the support device from below so as to effect a base fluidization which contributes to a loosening of the material layer lying on the material support device. The loosened material layer exhibits a reduced resistance than would be exhibited by a material layer on the material bed support device which had not been subjected to a constant air or gas flow. As a result of this sifting movement, the layers of the material bed sort themselves into the relatively heavier material layer and the relatively lighter material layer.

Figure 3:
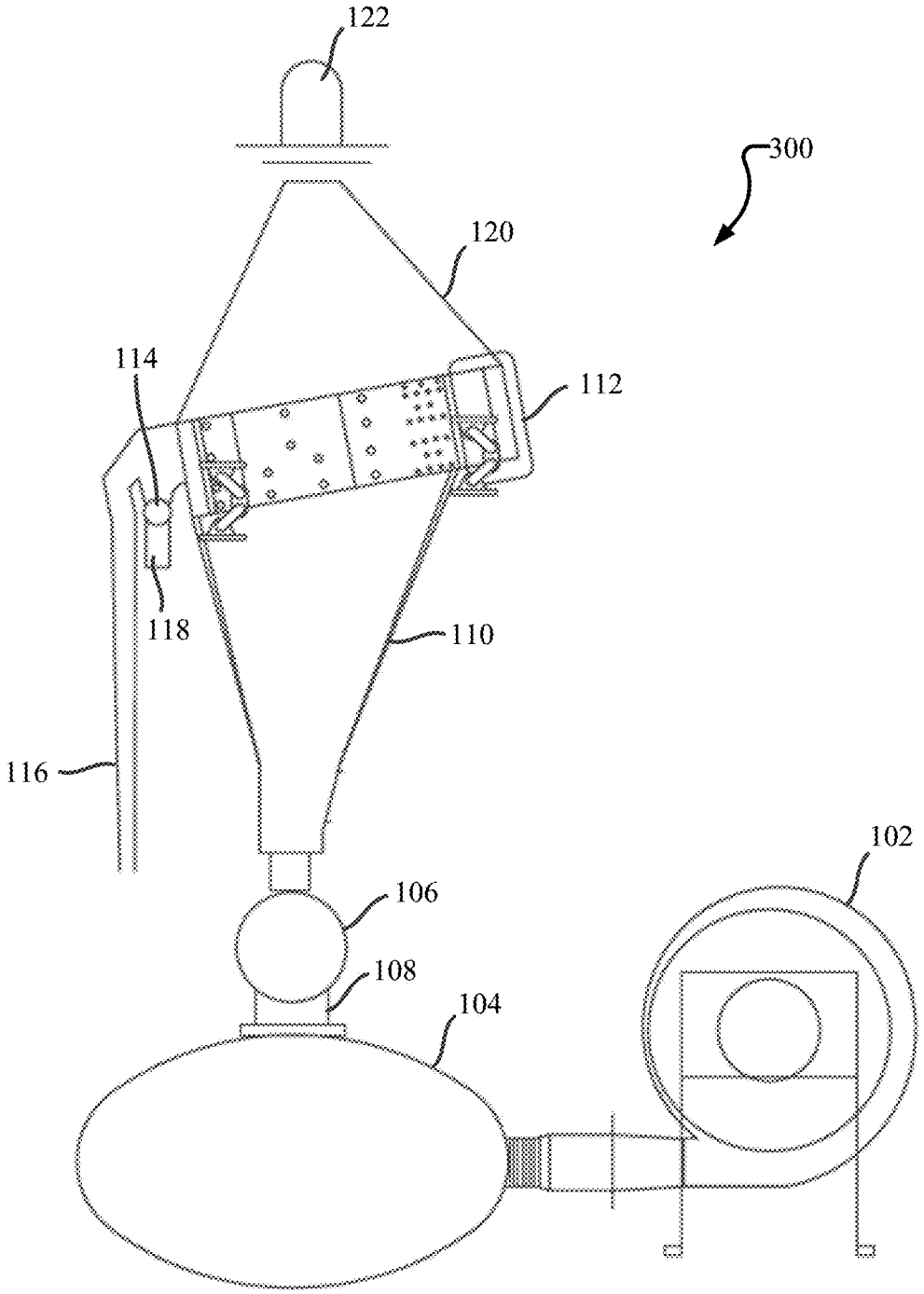
FIG. 3 is a schematic side view of embodiments of another sifting apparatus of the present disclosure having a reservoir.

FIG. 3 illustrates a further sifting apparatus 300 having a reservoir 104 according to the present disclosure. It should be appreciated that the sifting apparatus 300 of FIG. 3 may include all or substantially all of the components discussed with respect to the sifting apparatus 100 of FIG. 1. It should also be appreciated that the components of the sifting apparatus 100 may be implemented within the sifting apparatus 300 in similar or identical configurations/orientations, unless explicitly differentiated herein below.

The sifting apparatus 300 may include a dust collection housing 120 configured to manage an amount of dust released by the sifting apparatus 300. The dust collection housing 120 may have any shape that allows the dust collection housing 120 to prevent dust from being released from the sifting apparatus 300 into the surrounding environment. The dust collection housing 120 may be attached to the material support unit 112 by fasteners such as screws, clamps, snaps, epoxies, resins, and seals, for example.

Additionally, ducting 122 may be attached to the dust collection housing 120. The sifting apparatus 300 may also include a material feed-in unit/device (not illustrated in FIG. 3).

The material support unit 112 may include a sloped surface, offset from horizontal, upon which material mixtures are separated into relatively "light" and relatively "heavy" materials. As described herein, pulsated air causes light materials (i.e., less dense materials) to rise in the material mixture, thereby generating a light material layer atop of a heavy material (i.e., more dense material) layer.

The slope of the material support unit 112 directs materials thereon to a discharge control mechanism 114. The discharge control mechanism 114 allows for the adjustable selection or control of heavy material capable of passing through the discharge control mechanism 114 and the heavy product discharge channel 118. Consequently, the discharge control mechanism 114 also controls the amount of light material that passes to the light product discharge channel 116. For example, by decreasing the amount of heavy materials allowed to pass to the heavy product discharge channel 118, the more materials build up on the material support unit 112, and consequently the more products are released through the light product discharge channel 116, and vice versa. The discharge control mechanism 114 can be a movable bed, a star gate, a clam shell, a drag conveyor, a lifting wheel, a bottom gate, a vibrating plate, a vibrating screen, or like mechanism. For example, when the discharge control mechanism 114 is a rotary (e.g., star gate) device, the faster the rotary device spins, the more heavy material is moved through the discharge control mechanism 114 to the heavy product discharge channel 118, and vice versa.

Located below the material support unit 112 is a plenum 110 configured to provide the material support unit 112 with a pulsated medium of gas or air. The plenum 110 may be directly or indirectly coupled to a bottom portion of the material support unit 112. The plenum 110 may have a shape that enables the plenum 110 to evenly distribute air to the material support unit 112. For example, the plenum 110 may have a conical shape, with a "large" opening of the plenum 110 being proximate to the material support unit 112 and a "small" opening of the plenum 110 being distal from the material support unit 112.

The sifting apparatus 300 additionally includes a pressure release unit configured to release pressure from the reservoir 104 to the plenum 110, resulting in the pulsated air experienced by the material support unit 112. The pressure release unit includes the metering valve 106 and adjustable orifice 108. The metering valve 106 may be a flutter valve that intermittently pulsates air (i.e., releases air from the reservoir 104) into the plenum 110. The metering valve 106, and optionally the adjustable orifice 108, may be located directly below the plenum 110, between the reservoir 104 and the plenum 110. For example, the metering valve 106 may be centrally locate below the plenum 110 so a single vertical axis extends through both the plenum 110 and the metering valve 106. By placing the metering valve 106 below the material support unit 112 (i.e., below the plenum 110), an even distribution of air to the material support unit 112 is achieved, thereby resulting in greater separation as compared to traditional air sifting apparatuses.

The adjustable orifice 108 is configured to regulate flow pressure and/or rate of the gas/air released to the plenum 110 by the metering valve 106. This allows a user, or a computing device configured to control the metering valve 106, to manipulate the metering valve 106 to control the frequency and volume of pulsations of gas into the plenum 110.

Several benefits arise from placing the metering valve 106 vertically below the plenum 110 (i.e., vertically below the material support unit 112). For example, an increased stratification and separation of materials as compared to traditional air sifting apparatuses/jigs is achieved. Moreover, turbulence and unexpected direction of pulsated air flows are reduced, thereby allowing the pulsated air to more evenly disperse under and through the material support unit 112.

The sifting apparatus 300 further includes a pressure build up system including the pump 102 and the reservoir 104. The reservoir 104 of the sifting apparatus 300 may be located vertically beneath the plenum 110 (e.g., a vertical axis may extend through the reservoir 104 and the plenum 110, or exterior edges of the reservoir 104 are vertically in line with exterior-most edges of the plenum 110). By pumping air into the reservoir 104, a constant or substantially constant pressure is maintained for the pump 102 to work against. This results in less stress on the bearing of the air pump 102.

Figure 4:
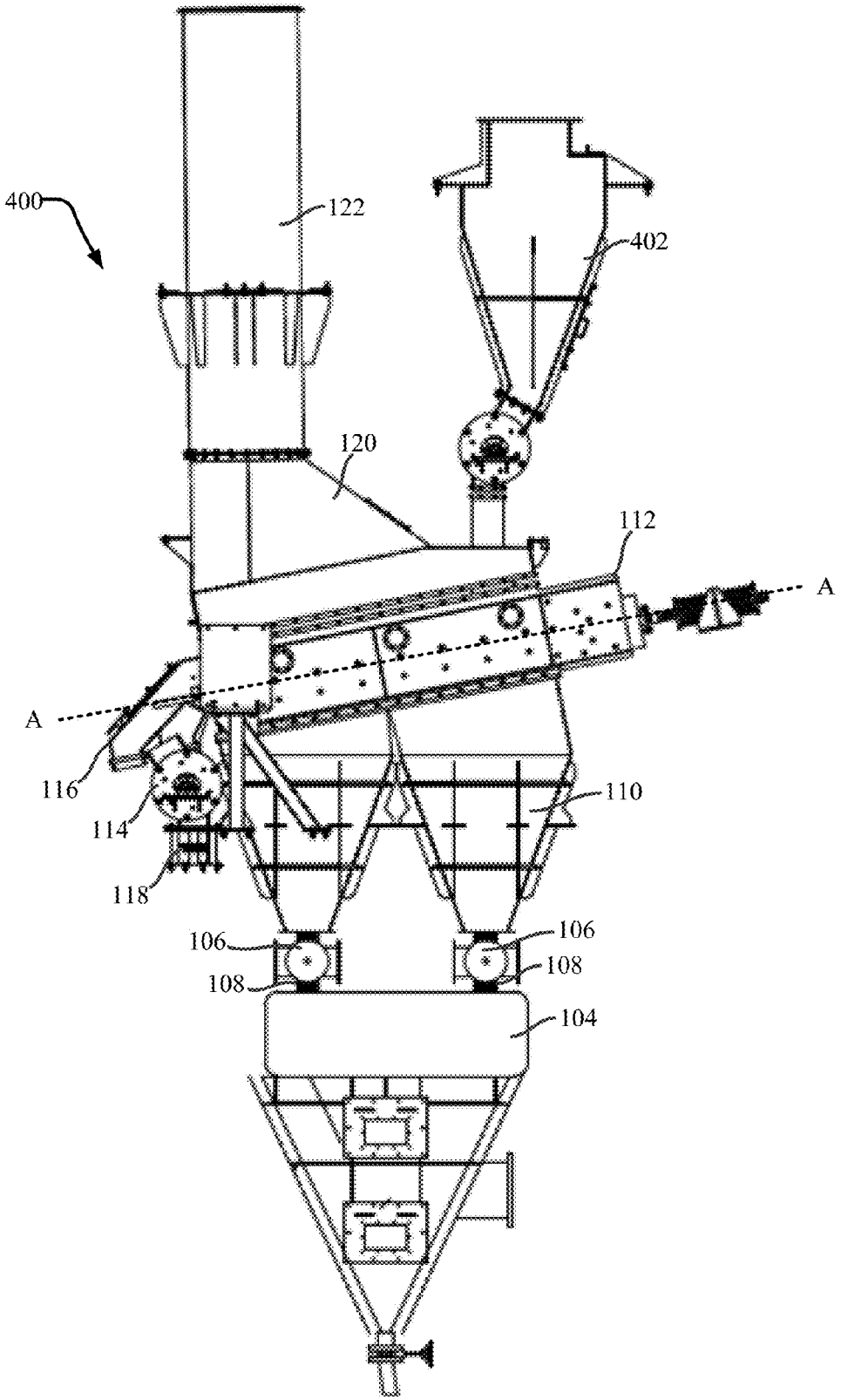
FIG. 4 is a schematic side view of embodiments of another sifting apparatus of the present disclosure having a reservoir.

FIG. 4 illustrates yet another sifting apparatus 400 of the present disclosure. The sifting apparatus 400 may include all or substantially all of the components discussed with respect to the sifting apparatus 300 of FIG. 3. It should also be appreciated that the components of the sifting apparatus 300 may be implemented within the sifting apparatus 400 in similar or identical configurations/orientations, unless explicitly differentiated herein below.

The sifting apparatus 400 includes a material feed-in device 402 configured to replenish a material mixture to the material support unit 112. For example, the material feed-in device 402 may provide the material mixture in uniform or substantially uniform dosages, or may provide the material mixture variably. Replenishment of material mixture by the material feed-in device 402 may be calculated according to volume, density, or weight of the material mixture, for example.

The material feed-in device 402 is located proximate to the material support unit 112. For example, an outlet of the material feed-in device 402 may be located above the material support unit 112 such that materials released by the material feed-in device 402 are provided to a top/elevated portion of the material support unit 112. Alternatively, an outlet of the material feed-in device 402 may be located horizontally with respect to the material support unit 112. In this example, materials released by the material feed-in device 402 are provided to a side portion of the material support unit 112.

The sifting apparatus 400 may include more than one plenum 110. When one plenum 110 is implemented (as illustrated in FIGS. 1 and 3), a top portion of the plenum 110 may correspond or substantially correspond in size and/or shape to a bottom of the material support unit 112. When more than one plenum 110 is implemented (as illustrated in FIG. 4), top portions of the plenums 110, collectively, may correspond or substantially correspond in size and/or shape to a bottom of the material support unit 112. By configuring the plenums 110 as such, the plenums 110 are able to distribute air to all or nearly all of an underside of the material support unit 112.

Moreover, when more than one plenum 110 is implemented, the plenums 110 may be horizontally located with respect to each other (i.e., the plenums 110 may be located side-by-side as illustrated in FIG. 4). When more than one plenum 110 is implemented, the plenums 110 may be equal or substantially equal in size and/or shape, or the plenums 110 may have unequal sizes and/or shapes. Alternatively, the plenums 110 may be vertically located with respect to each other.

As illustrated and described, each metering valve 106 has a single corresponding adjustable orifice 108. Yet, one skilled in the art should appreciate that each metering valve 106 may have more than one corresponding adjustable orifice 108 without departing from the scope of the present disclosure. Additionally, as illustrated, each plenum 110 of the sifting apparatus 300 may have a single corresponding metering valve 106 and adjustable orifice 108. However, it should be appreciated that each plenum 110 may have more than one corresponding metering valve 106 and/or adjustable orifice 108 without departing from the scope of the present disclosure.

Moreover, the sifting apparatus 400 may have more than one metering valve 106. Each metering valve 106 may provide an equal or substantially equal amount and/or magnitude of gaseous flow (i.e., pulsating and/or steady stream flow) to the material support unit 112. Alternatively, each metering valve 106 may provide a different amount and/or magnitude of gaseous flow to the material support unit 112. Additionally, some of the metering valves 106 may provide a steady stream of gaseous material to the material support unit 112 while other metering valves 106 provide a pulsating gaseous material to the material support unit 112.

As illustrated and described, each metering valve 106 has a single corresponding adjustable orifice 108. However, one skilled in the art should appreciate that each metering valve 106 may have more than one corresponding adjustable orifice 108 without departing from the scope of the present disclosure. Additionally, as illustrated, each plenum 110 of the sifting apparatuses of the present disclosure may have a single corresponding metering valve 106 and adjustable orifice 108. However, it should be appreciated that each plenum 110 may have more than one corresponding metering valve 106 and/or adjustable orifice 108 without departing from the scope of the present disclosure.

Efficient stratification of materials is obtainable by the sifting apparatuses of the present disclosure by balancing the frequency, amplitude, and acceleration of each jigging stroke of the sifting apparatus. By placing the metering valve 106 (and optionally the reservoir 104) below the material support unit 112, the metering valve 106 is able to provide relatively independent control of the acceleration of each jigging stroke received by the material on the material support unit 112. Accordingly, air sifting apparatuses of the present disclosure can provide a greater mass of air to the material support unit 112 as compared to traditional air jigs. For example, the air sifting apparatuses of the present disclosure are capable of achieving pressures from two (2) to greater than ten (10) times that of traditional air jigs. Moreover, to allow large, relatively high density materials to fall from a higher layer to a lower layer of mixed sized and density materials, it may be beneficial to expand a bed of mixed materials to cover a surface area larger than that allowed for by traditional material support units.

To further enhance the efficiency of separation of mixed size and density materials, a relatively high density layer may be maintained on the material support unit 112. By maintaining a reserve layer of relatively high density materials, relatively low density materials are prevented from being misplaced with the relatively high density materials (i.e., relatively low density materials are prevented from entering the heavy product discharge channel 118, which, in beneficial implementations, would receive little to no relatively low density materials). If relatively high density materials are withdrawn from the material support unit 112 (via the heavy product discharge channel 118) in direct proportion to the amount of relatively high density materials provided to the material support unit 112 by the material feed-in device 402, a relatively constant layer of relatively high density materials may be maintained on the material support unit 112.

As illustrated in FIGS. 1, 3, and 4, the light product discharge channel 116 mates to the material support unit 112 directly above where the discharge control mechanism 114 mates to the material support unit 112. When the material mixture is separated into light materials and heavy materials, there exists an interface/split-point between the light materials and heavy materials. In order for the maximum amount of light materials to be directed to the light product discharge channel 116, the interface between the light materials and heavy materials should be configured between or substantially between the light product discharge channel 116 and the discharge control mechanism 114 (illustrated as dashed line A-A).

Traditionally, a user would control operation of the discharge control mechanism 114 to control the level of the interface within the material support unit 112. For example, if the interface was too high in the material support unit 112, the discharge control mechanism 114 would be manually changed to increase the rate at which heavy material is allowed to pass through the discharge control mechanism 114, and vice versa.

Figure 5:
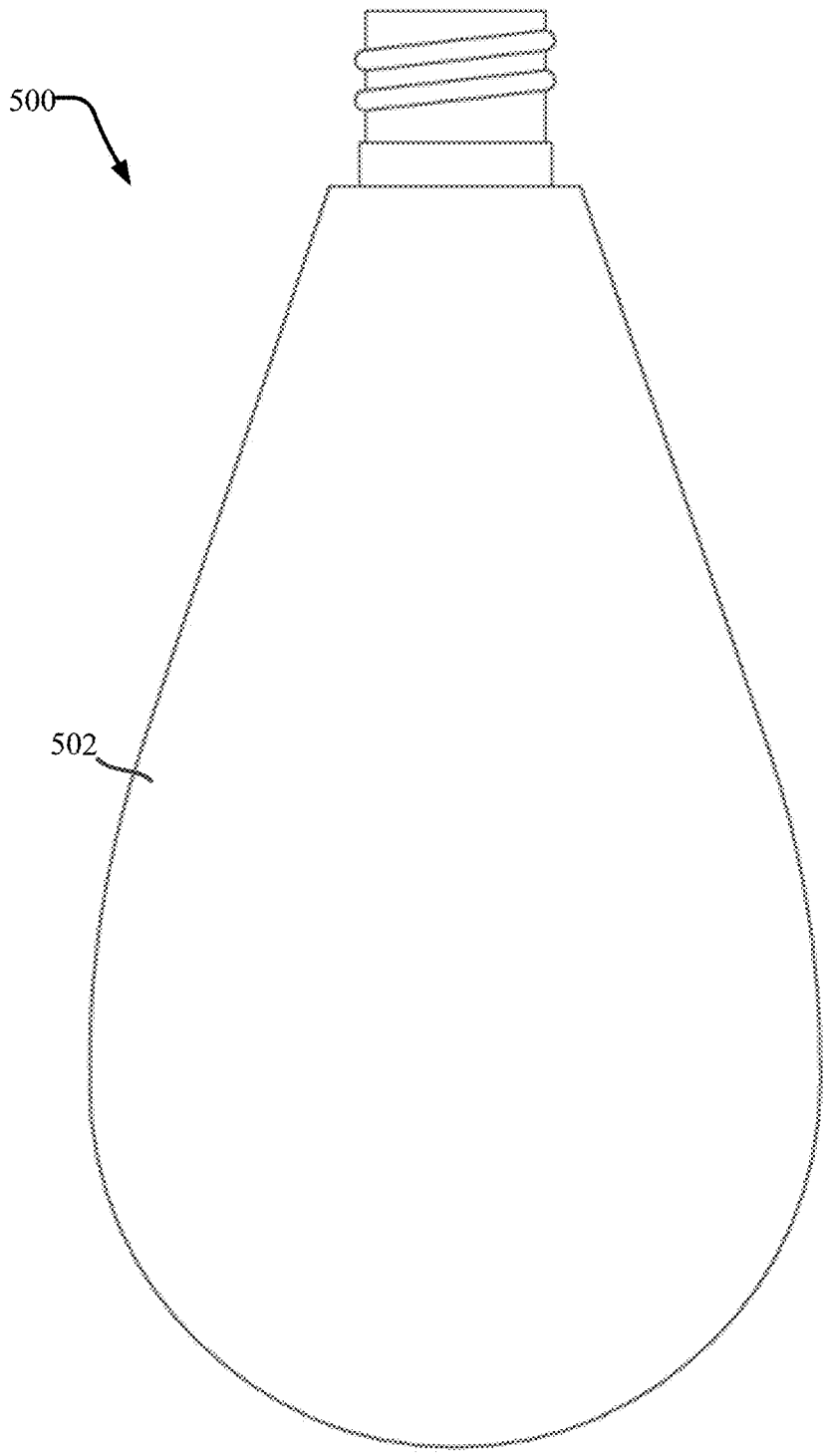
FIG. 5 is a side view of an illustrative embodiment of an interface level detector according to the present disclosure.

FIG. 5 of the present disclosure illustrates an interface level detector 500 that allows a level of the interface between "light" and "heavy" materials to be automatically determined and manipulated without user interaction (e.g., via computer). By determining a location of the interface level detector 500 within the material support unit 112, the discharge control mechanism 114 may be automatically controlled to control the interface between the heavy and light materials. The interface level detector 500 mimics a particle of relatively high density due to weight(s) placed within or on the interface level detector 500. By adding or subtracting weight from the interface level detector 500, the interface level detector 500 may reside at any density strata. Once a density strata is identified as being composed of particles similar in density to particles mimicked by the interface level detector 500, it is only necessary to measure the location of the interface level device 500 relative to a weir or other fixed point on the material support unit 112 at the discharge end of the air sifting apparatus. Through common measurement techniques any displacement of the interface level detector 500 can be used as a control signal to actuate the discharge control mechanism 114 to discharge an appropriate amount of heavy materials from the material support unit 112. If the feed material contains a greater portion of high density particles, the interface level detector 500 will rise within the material support unit 112 as material is added to and moved through the material support unit 112. The corollary is also true. If less high density particles are delivered to the air sifting apparatus, the interface level detector 500 will fall within the material support unit 112 as material is added to and moved through the material support unit 112.

The discharge control mechanism 114 is operable with the interface level detector 500 to automatically withdraw relatively high density materials from the material support unit 112 in direct proportion to the amount of relatively high density materials provided to the material support unit 112 by the material feed-in unit 402. For example, when it is detected that the interface level detector 500 has risen above a desired/threshold location within the material support unit 112, the discharge control mechanism 114 is automatically engaged to release heavy products through the heavy product discharge channel 118 at a greater rate until the interface level detector 500 relocates to the desired location. Contrarily, when it is detected that the interface level detector 500 has fallen below a desired location within the material support unit 112, the discharge control mechanism 114 is automatically engaged to reduce or stop the release of heavy products through the heavy product discharge channel 118 until the interface level detector 500 relocates to the desired location.

The interface level detector 500 may be made of glass, metal, plastic, or other like solid material. The interface level detector 500, as illustrated, has a bulbous exterior shape into which weight is placed. However, one skilled in the art should appreciate that the interface level detector 500 may have other shapes without departing from the scope of the present disclosure. Illustrative weights include bearings or like solid materials having known weights, for example. By implementing the illustrated interface level detector 500, a nuclear density detection device, which is typically used with air sifting apparatuses, may be omitted. The illustrated interface level detector 500 also enables the air sifting apparatus to achieve a discharge system identical to those used in traditional wet jigging apparatuses.

Figure 6:
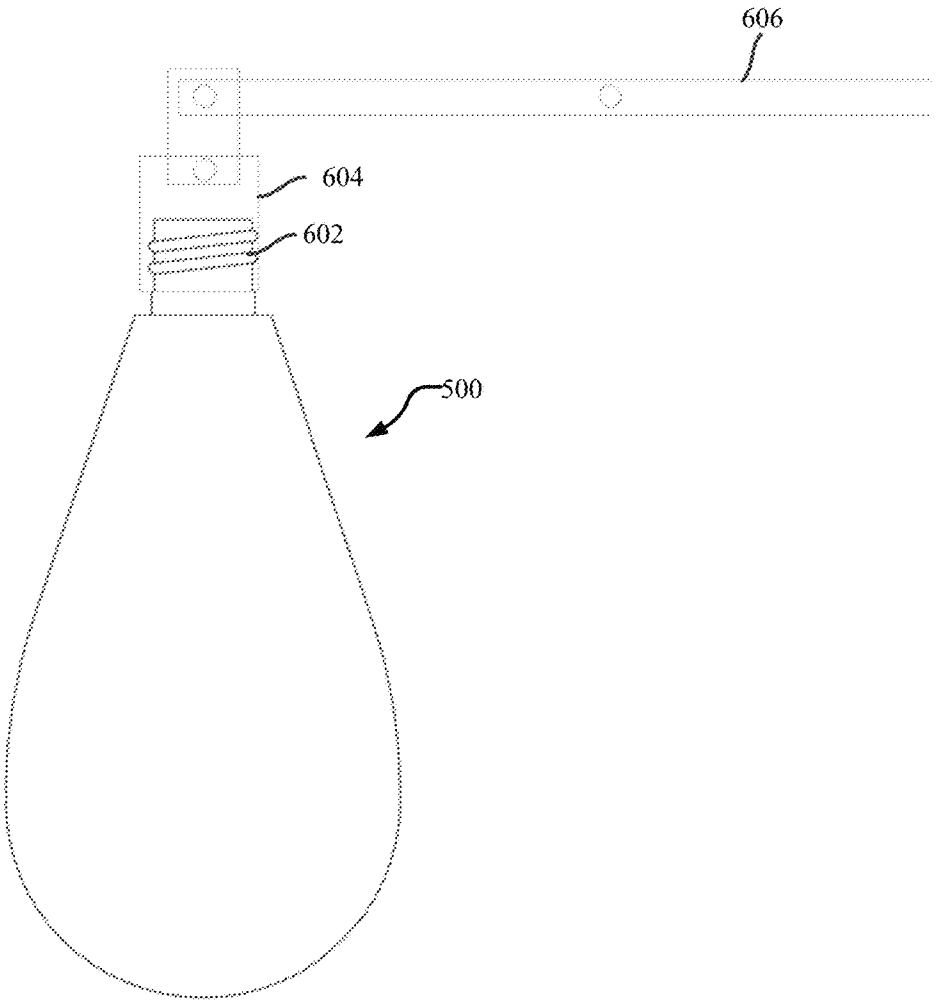
FIG. 6 is a schematic side view of an interface level detector implemented in an embodiment of a sifting apparatus of the present disclosure.

FIG. 6 illustrates the interface level detector 500 as it would be implemented within the material support unit 112 of a sifting apparatus. The interface level detector 500 includes an end 602 that couples to an end 604 of an arm 606 within the material support unit 112. The ends 602/604 of the interface level detector 500 and arm 606 may couple via threads, male/female members, friction, etc. The arm 606 connects to a weir or other fixed point on the material support unit 112. As materials are moved through the material support unit 112, measurements of the displacement of the interface level detector 500 are taken and used to determine the speed at which the discharge control mechanism 114 should operate, as described herein above with respect to FIG. 5. As illustrated, movement of the interface level detector 500 within the material support unit 112 is determined by measuring displacement of the arm 606. However, one skilled in the art should appreciate that the location of the interface level detector 500 within the material support unit 112 may be determined using non-lever techniques. For example, movement of the interface level detector 500 may be determined using infrared measurements, sonic measurements, magnetic techniques, etc.

The present disclosure is, of course, in no way restricted to the specific disclosure of the specification and drawings, but also encompasses any modifications within the scope of the appended claims.

What is claimed is:

1. An apparatus, comprising:

a material support unit;

a plenum coupled to an underside of the material support unit;

a metering valve coupled to the plenum and in fluidic communication with the material support unit, the metering valve providing a pulsating gaseous medium flow to the material support unit;

a reservoir coupled to the metering valve and in fluidic communication with the material support unit;

a pump coupled to the reservoir, the pump maintaining a gaseous medium within the reservoir at a substantially constant pressure, wherein the reservoir is positioned between the pump and the metering device;

an interface level detector coupled to the material support unit, the interface level detector measuring a depth of a density layer between relatively heavy and relatively light materials located on the material support unit; and a discharge control mechanism coupled to the material support unit and operable to control discharge of a relatively heavy material.

2. The apparatus of claim 1, further comprising an adjustable orifice that regulates a volume of the pulsating gaseous medium flow.

3. The apparatus of claim 2, wherein the adjustable orifice is located between the metering valve and the reservoir.

4. The apparatus of claim 1, wherein the pulsating gaseous medium flow has a pressure corresponding to the substantially constant pressure maintained in the reservoir by the pump.

5. The apparatus of claim 2, wherein the reservoir is configured to minimize a pressure drop resulting from periodic opening and closing of the metering valve.

6. The apparatus of claim 1, wherein the interface level detector is bulbous.

7. The apparatus of claim 6, wherein the interface level detector controls a rate at which relatively heavy materials are removed from the material support unit.

8. A apparatus, comprising:

a material support unit having apertures located therethrough;

a plenum coupled to the material support unit;

an metering valve coupled to the plenum and in fluidic communication with the material support unit, the metering valve being located vertically below the material support unit, the metering valve providing a pulsating gaseous medium flow to materials in the material support unit via the apertures; a reservoir in fluidic communication with an adjustable orifice; wherein the reservoir is positioned between the pump and the metering device;

an interface level detector coupled to the material support unit, the interface level detector measuring a depth of a density layer between relatively heavy and relatively light materials located on the material support unit; and a pump in fluidic communication with the reservoir, the pump maintaining a gaseous medium within the reservoir at a substantially constant pressure.

9. The apparatus of claim 8, further comprising a discharge control mechanism configured to remove relatively heavy materials from the material support unit, and wherein a rate of relatively heavy materials removed from the material support unit corresponds with a location of the interface level detector within the material support unit.

10. The apparatus of claim 8, further comprising:

an interface level detector located within the material support unit;

a material feed-in unit configured to supply relatively heavy materials and relatively light materials to the material support unit; and a discharge control mechanism configured to remove an amount of relatively heavy materials from the material support unit in direct proportion to an amount of relatively heavy materials supplied to the material support unit by the material feed-in unit based on a location of the interface level detector within the material support unit.

11. The apparatus of claim 8, further comprising an interface level detector located within the material support unit, a location of the interface level detector within the material support unit automatically controlling a rate at which relatively heavy materials are dispensed from the apparatus.

12. The apparatus of claim 8, wherein the reservoir is located centrally below the material support unit.

13. A apparatus, comprising:

a material support unit;

a first plenum coupled to an underside of the material support unit;

a first metering valve coupled to the plenum and in fluidic communication with the material support unit, the first metering valve being located vertically below the material support unit, the first metering valve providing a pulsating gaseous medium flow to the material support unit;

a reservoir in fluidic communication with the first metering valve wherein the reservoir is positioned between the pump and the metering device, the reservoir dispensing gaseous material to the first metering valve in a substantially constant flow, the substantially constant flow causing the first plenum to experience minimal pressure drop after each pulse of the pulsating gaseous medium flow;

an interface level detector coupled to the material support unit, the interface level detector measuring a depth of a density layer between relatively heavy and relatively light materials located on the material support unit; and a pump in fluidic communication with the reservoir, wherein the pump provides a pressurized medium.

14. The apparatus of claim 13, further comprising: a material feed-in unit configured to supply relatively heavy and relatively light materials to the material support unit; a discharge control mechanism configured to remove an amount of relatively heavy materials from the material support unit in direct proportion to an amount of relatively heavy materials supplied to the material support unit by the material feed-in unit; and an interface level detector configured to measure an interface between relatively heavy materials and relatively light materials in the material support unit, the interface level detector configured to cause the discharge control mechanism to change a rate at which the discharge control mechanism removes relatively heavy materials from the material support unit.

15. The apparatus of claim 13, further comprising: a second plenum coupled to the material support unit; and a second metering valve coupled to the second plenum and in fluidic communication with the material support unit, the first and second metering valves each being coupled to the reservoir.

16. The apparatus of claim 15, wherein the first and second plenums are horizontally located with respect to each other.

17. The apparatus of claim 15, wherein the first and second metering valves provide substantially equal magnitude pulses of gaseous material flow to the material support unit.

18. The apparatus of claim 15, wherein the first metering valve provides a first magnitude of gaseous material flow to the material support unit and the second metering valve provides a second magnitude of gaseous material flow to the material support unit, and the first and second magnitudes of gaseous material flow are different.

* * * * *